US009915461B2

(12) United States Patent
An et al.

(10) Patent No.: US 9,915,461 B2
(45) Date of Patent: Mar. 13, 2018

(54) REFRIGERATOR

(71) Applicant: SAMSUNG ELECTRONICS CO., LTD., Suwon-si, Gyeonggi-do (KR)

(72) Inventors: Jae Koog An, Gwangju (KR); Kyoung Ki Park, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 655 days.

(21) Appl. No.: 13/857,699

(22) Filed: Apr. 5, 2013

(65) Prior Publication Data

US 2013/0263621 A1 Oct. 10, 2013

(30) Foreign Application Priority Data

Apr. 10, 2012 (KR) ..... 10-2012-0037203

(51) Int. Cl.
*F25C 5/00* (2006.01)
*F25C 5/18* (2018.01)
*F25D 11/02* (2006.01)

(52) U.S. Cl.
CPC ..... *F25C 5/185* (2013.01); *F25C 5/005* (2013.01); *F25C 5/182* (2013.01); *F25D 11/02* (2013.01)

(58) Field of Classification Search
CPC ..... E05B 65/0042; E05B 65/44; E05C 1/004; E05C 1/08; E05C 1/10; F25C 5/18; F25C 5/182; F25C 5/005; F25C 5/007
USPC ..... 62/340, 344; 312/402, 404, 222, 333, 312/319.1
See application file for complete search history.

(56) References Cited

U.S. PATENT DOCUMENTS 922,852 A * 5/1909 Cannan ..... A47B 88/047 217/62
3,582,174 A * 6/1971 Riley ..... A47B 88/0003 312/334.28
3,680,941 A * 8/1972 Shanks ..... A47B 88/0003 312/116
7,594,413 B2 9/2009 Martin et al.
7,870,754 B2 1/2011 Martin et al.
(Continued)

FOREIGN PATENT DOCUMENTS

CN 1940426 4/2007
CN 101512259 8/2009
(Continued)

OTHER PUBLICATIONS

Burtz, DE19514879TRANS (English Translation), Oct. 1996.*
(Continued)

*Primary Examiner* — Justin Jonaitis
*Assistant Examiner* — Eric Ruppert
(74) *Attorney, Agent, or Firm* — Staas & Halsey LLP

(57) ABSTRACT

A refrigerator includes an ice-making chamber, an ice bucket that can be slidably drawn into and out of the ice-making chamber, and a locking device that can lock the ice bucket, and the locking device may be provided in an upper wall of an inner case. Only a latch protrusion that protrudes upwardly is formed in the ice bucket so as to be coupled to the locking device, and therefore a structure of the ice bucket may be simplified, and an unnecessary opening may not be formed in the ice bucket, thereby preventing cool air of an inside of the ice bucket from leaking.

8 Claims, 12 Drawing Sheets

(56) References Cited

U.S. PATENT DOCUMENTS

| | | | | |
|---|---|---|---|---|
| 2006/0097610 | A1* | 5/2006 | Lee | F25D 23/04 312/401 |
| 2006/0201189 | A1* | 9/2006 | Adamski | F25C 5/005 62/334 |
| 2006/0260348 | A1 | 11/2006 | Martin et al. | |
| 2008/0134708 | A1* | 6/2008 | Lee | F25C 5/005 62/340 |
| 2010/0126204 | A1* | 5/2010 | Martin | F25C 5/007 62/344 |
| 2010/0162745 | A1* | 7/2010 | Kim | F25D 25/025 62/407 |
| 2011/0162405 | A1* | 7/2011 | Jeong | F25D 17/062 62/340 |

FOREIGN PATENT DOCUMENTS

| | | | | |
|---|---|---|---|---|
| DE | 195 14 879 | | 10/1996 | |
| DE | 19514879 | * | 10/1996 | |
| DE | 102007047117 | * | 4/2009 | F25C 5/005 |
| EP | 2 341 303 | | 7/2011 | |
| JP | 2001116410 | * | 4/2001 | |
| JP | 2007-71467 | | 3/2007 | |
| JP | 2007071467 | * | 3/2007 | |

OTHER PUBLICATIONS

Baer Winfried, DE102007047117TRANS (English Translation), Apr. 2009.*

Shiraishi, Hideo, JP2001116410TRANS (English Translation), Apr. 2001.*

Tahira, JP2007071467TRANS (English Translation), Mar. 2007.*

Chinese Office Action dated Mar. 30, 2016 from Chinese Patent Application No. 201310122315.9, 17 pages.

Extended European Search Report dated Nov. 14, 2016 from European Patent Application No. 13162883.6, 10 pages.

Chinese Office Action dated Sep. 12, 2016 from Chinese Patent Application No. 201310122315.9, 16 pages.

Chinese Office Action dated Mar. 13, 2017 from Chinese Patent Application No. 201310122315.9, 4 pages.

European Patent Office Communication Under Rule 71(3) EPC dated Oct. 13, 2017 in related EP Application No. 13 162 883.6.

* cited by examiner

REFRIGERATOR

CROSS-REFERENCE TO RELATED APPLICATIONS

This application claims the benefit of Korean Patent Application No. 10-2012-0037203, filed on Apr. 10, 2012 in the Korean Intellectual Property Office, the disclosure of which is incorporated herein by reference.

BACKGROUND

1. Field

Embodiments of the present disclosure relate to a structure that fixes an ice bucket in a refrigerator including an ice maker.

2. Description of the Related Art

In general, a refrigerator is a home appliance that includes a storage chamber for storing food and a cold air supply device for supplying cold air to the storage chamber to keep food fresh. In recent years, an ice maker that creates ice to meet demands of users may be provided in the refrigerator.

The ice maker may include an ice-making tray to which water is fed to create ice, an ejector that moves the ice created in the ice-making tray, an ice bucket that stores the ice moved from the ice-making tray, and an auger that transports the ice stored in the ice bucket. In particular, the ice bucket may be provided so as to be slidably drawn into an ice-making chamber or slidably drawn to the outside of the ice-making chamber so that the storage ice may be easily taken out.

In addition, in the refrigerator, a locking device that can lock the ice bucket while the ice bucket is drawn into the ice-making chamber may be provided. An example of the refrigerator including the locking device is disclosed in U.S. Pat. No. 7,870,754 and U.S. Pat. No. 7,594,413.

According to U.S. Pat. No. 7,870,754 and U.S. Pat. No. 7,594,413, the locking device is provided in the ice bucket, and therefore the ice bucket may have a complex structure.

SUMMARY

Therefore, it is an aspect of the present disclosure to provide a locking structure that can lock an ice bucket while the ice bucket is drawn into an ice-making chamber.

In addition, it is another aspect of the present disclosure to provide a locking structure that can simplify a structure of an ice bucket.

Additional aspects of the disclosure will be set forth in part in the description which follows and, in part, will be apparent from the description, or may be learned by practice of the disclosure.

In accordance with one aspect of the present disclosure, a refrigerator including: a main body that includes an inner case having an upper wall, both sidewalls, a rear wall, and a bottom wall, an outer case coupled to an outer side of the inner case, and a heat insulating material foamed between the inner case and the outer case; a storage chamber that is formed inside the inner case; an ice-making chamber that is formed so as to be partitioned from the storage chamber, at least a part of the ice-making chamber being formed by the upper wall and the both sidewalls; an ice-making tray that is disposed inside the ice-making chamber to create ice; an ice bucket that stores the ice created in the ice-making tray, and is drawn into the ice-making chamber or drawn to the outside of the ice-making chamber; and a locking device that locks or unlocks the ice bucket drawn into the ice-making chamber, wherein the locking device is formed separately from the ice bucket and coupled to the upper wall of the inner case, and a latch protrusion that is interfered with by the locking device is formed on an upper portion of the ice bucket.

Here, the locking device may include a movement member having a latched portion that is interfered with by the latch protrusion, and an elastic member to elastically bias the movement member in a direction in which the latched portion is interfered with by the latch protrusion.

In addition, the movement member may include a push unit to release the interferences of the latched portion and latch protrusion by pressurizing the movement member.

In addition, the locking device may include a housing case having a housing space to house the movement member and the elastic member and one opened surface, and a cover coupled to the one opened surface of the housing case so as to cover the one opened surface of the housing case.

In addition, the latch protrusion may include a pressurizing surface for pressurizing the latched portion and a first interference surface interfered with by the latched portion, and the latched portion may include a pressurized surface pressurized by the pressurizing surface and a second interference surface interfered with by the first interference surface to lock the ice bucket.

In addition, the pressurized surface may be formed so as to be inclined so that the movement member is moved in a direction perpendicular to an advancing direction of the ice bucket when the pressurized surface is pressurized by the pressurizing surface.

In addition, the refrigerator may further include an ice-making chamber case coupled to an inner side of the inner case so as to form the ice-making chamber and to have a front surface edge unit with which the ice bucket is brought into close contact, wherein a first lower protrusion that protrudes so as to fix a lower portion of the ice bucket is formed in a lower portion of the front surface edge unit, and a second lower protrusion that is interfered with by the first lower protrusion is formed in the lower portion of the ice bucket.

In addition, the ice bucket that is drawn into the ice-making chamber and fixed by the first lower protrusion and the second lower protrusion may be lifted up to release the interference between the first lower protrusion and the second lower protrusion, and drawn to the outside of the ice-making chamber.

In addition, the first lower protrusion may include a first latch corner and a first interference surface formed so as to be inclined on an inner side of the first latch corner, the second lower protrusion may include a second latch corner and a second interference surface formed so as to be inclined on an inner side of the second latch corner, and the lower portion of the ice bucket may be fixed to a lower portion of the ice-making chamber case in such a manner that the first interference surface is interfered with by the second interference surface.

In addition, the first lower protrusion may include a first guide surface that is formed so as to be inclined on an outer side of the first latch corner, and the second lower protrusion may include a second guide surface that is formed so as to be inclined on an outer side of the second latch corner so that the second guide surface is slidably moved on the first guide surface to guide the ice bucket.

In accordance with another aspect of the present disclosure, a refrigerator including: a main body; an ice-making chamber that is formed in an inner upper portion of the main body; an ice-making chamber case that forms the ice-making chamber; an ice bucket that is drawn into the ice-making chamber or drawn to the outside of the ice-making chamber; a locking device that is provided in an upper portion of the main body to lock or unlock the ice bucket so as to lock or unlock the ice bucket while the ice bucket is drawn into the ice-making chamber; and a first lower protrusion that is formed in the ice-making chamber case so as to fix a lower portion of the ice bucket, wherein a latch protrusion that is interfered with by the locking device is formed in an upper portion of the ice bucket, and a second lower protrusion that is interfered with by the first lower protrusion is formed in the lower portion of the ice bucket.

Here, the locking device may include a movement member that advances and retreats in a direction perpendicular to an advancing direction of the ice bucket, the movement member may include a latched portion interfered with by the latch protrusion and a push unit configured to pressurize the movement member so as to release the interferences of the latch protrusion and latched portion, and the push unit may be exposed to a side of the ice bucket.

In addition, the locking device may include an elastic member configured to restore a position of the movement member when external pressurization to the push unit is removed.

In addition, the locking device may include a housing case having a housing space for housing the movement member and the elastic member and at least one stopper to limit a movement range of the movement member.

In addition, the ice bucket may be fixed to the ice-making chamber in such a manner that the latched portion and the latch protrusion are interfered with and the first lower protrusion and the second lower protrusion are interfered with, and the ice bucket may be drawn to the outside of the ice-making chamber in such a manner that the interferences of the latched portion and latch protrusion are released by pressurizing the push unit and the interferences of the first and second lower protrusions are released by lifting up the ice bucket.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
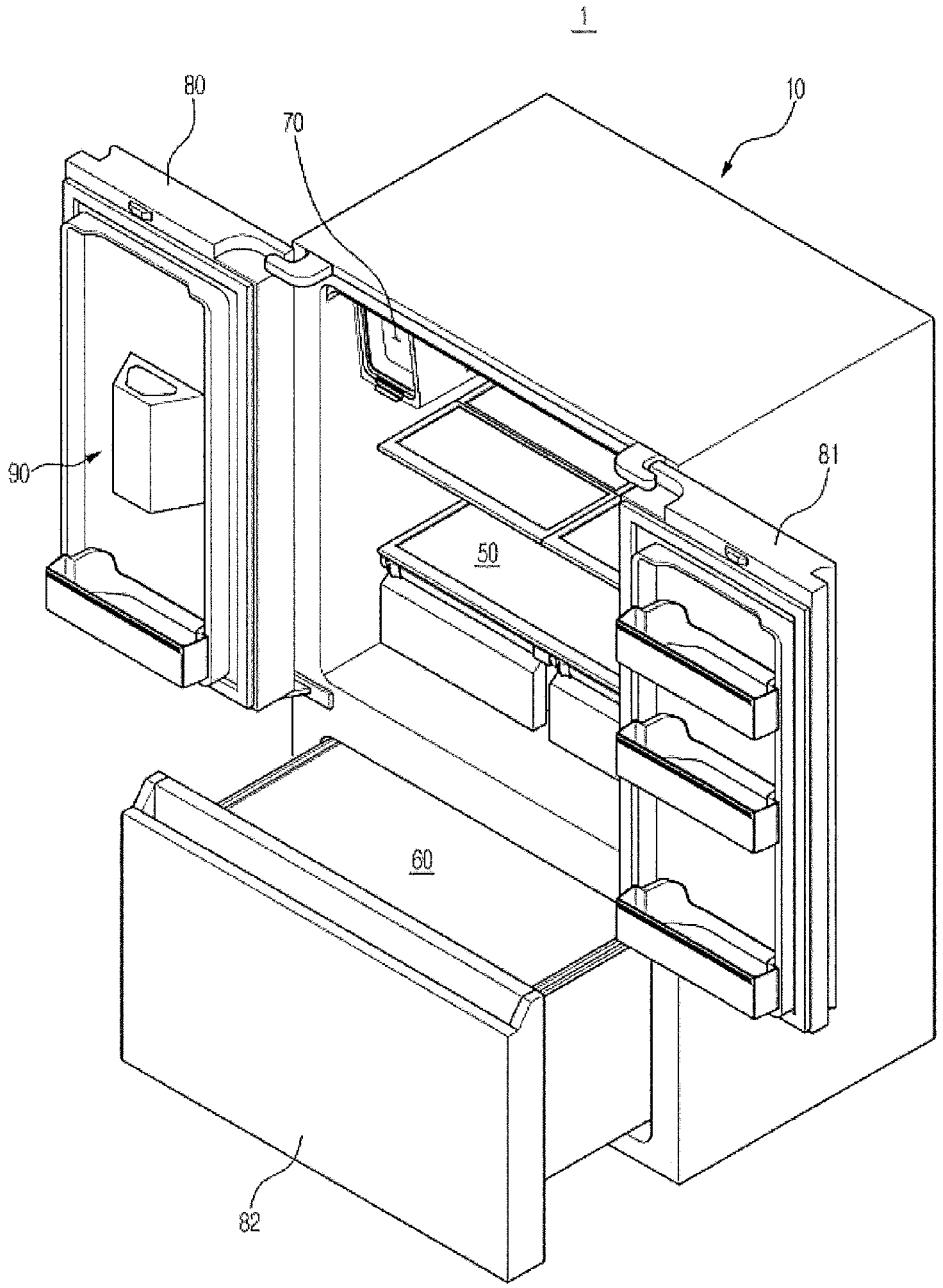
FIG. 1 is a perspective view showing an appearance of a refrigerator in accordance with an embodiment of the present disclosure.

Reference will now be made in detail to the embodiments of the present disclosure, examples of which are illustrated in the accompanying drawings, wherein like reference numerals refer to like elements throughout.

Figure 2:
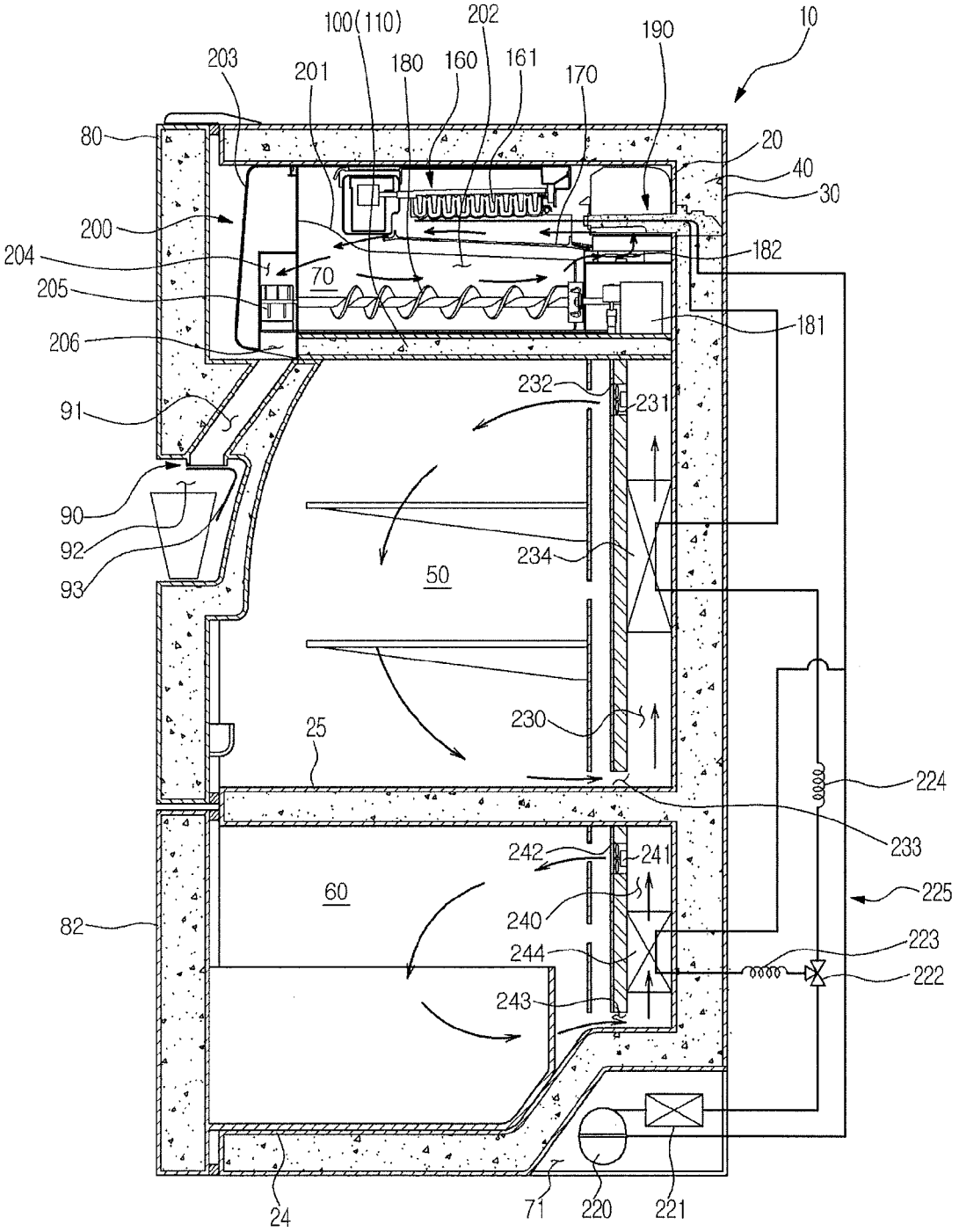
FIG. 2 is a schematic side cross-sectional view showing the refrigerator of FIG. 1.
Figure 3:
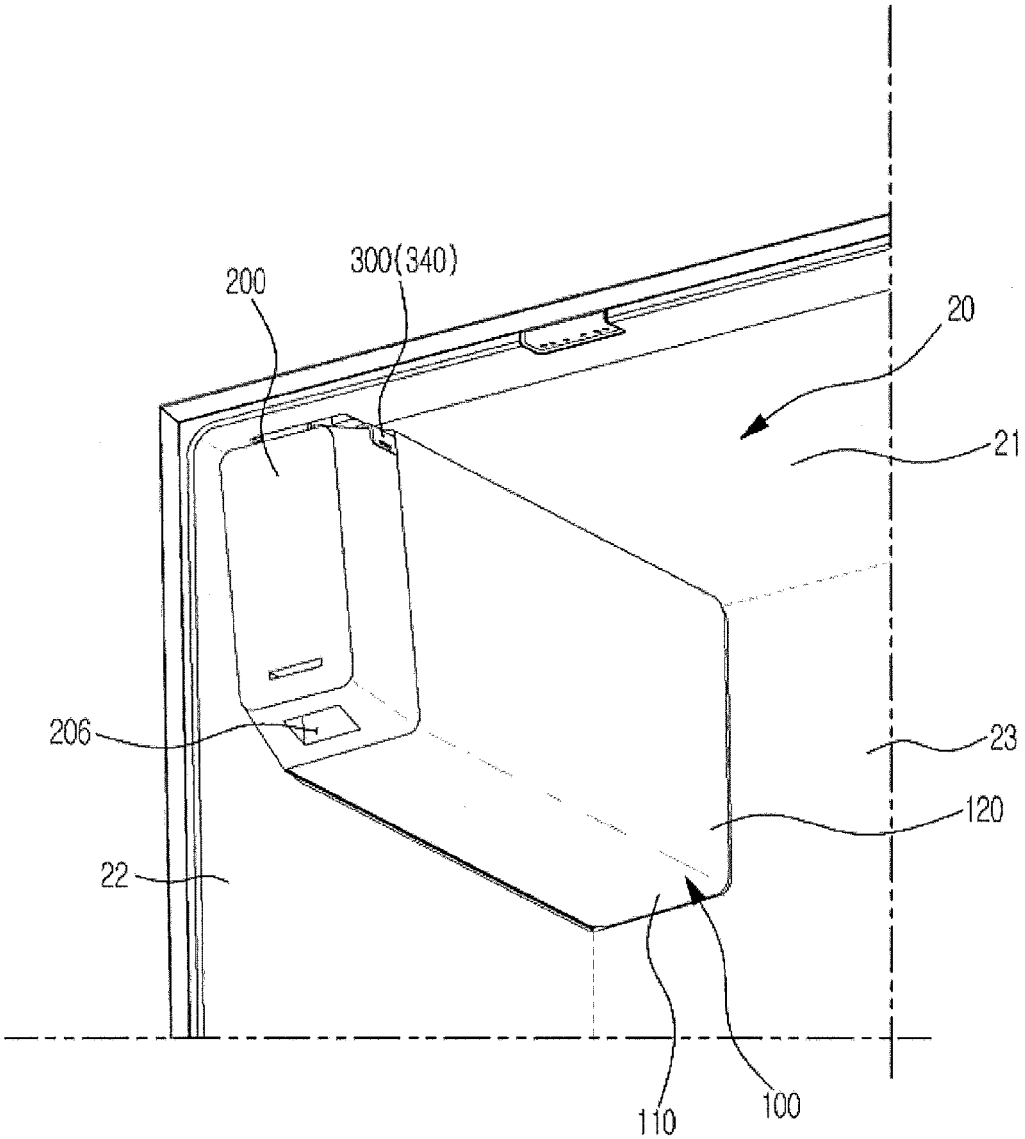
FIG. 3 is a view showing a state in which an ice bucket is drawn into an ice-making chamber of the refrigerator of FIG. 1.
Figure 4:
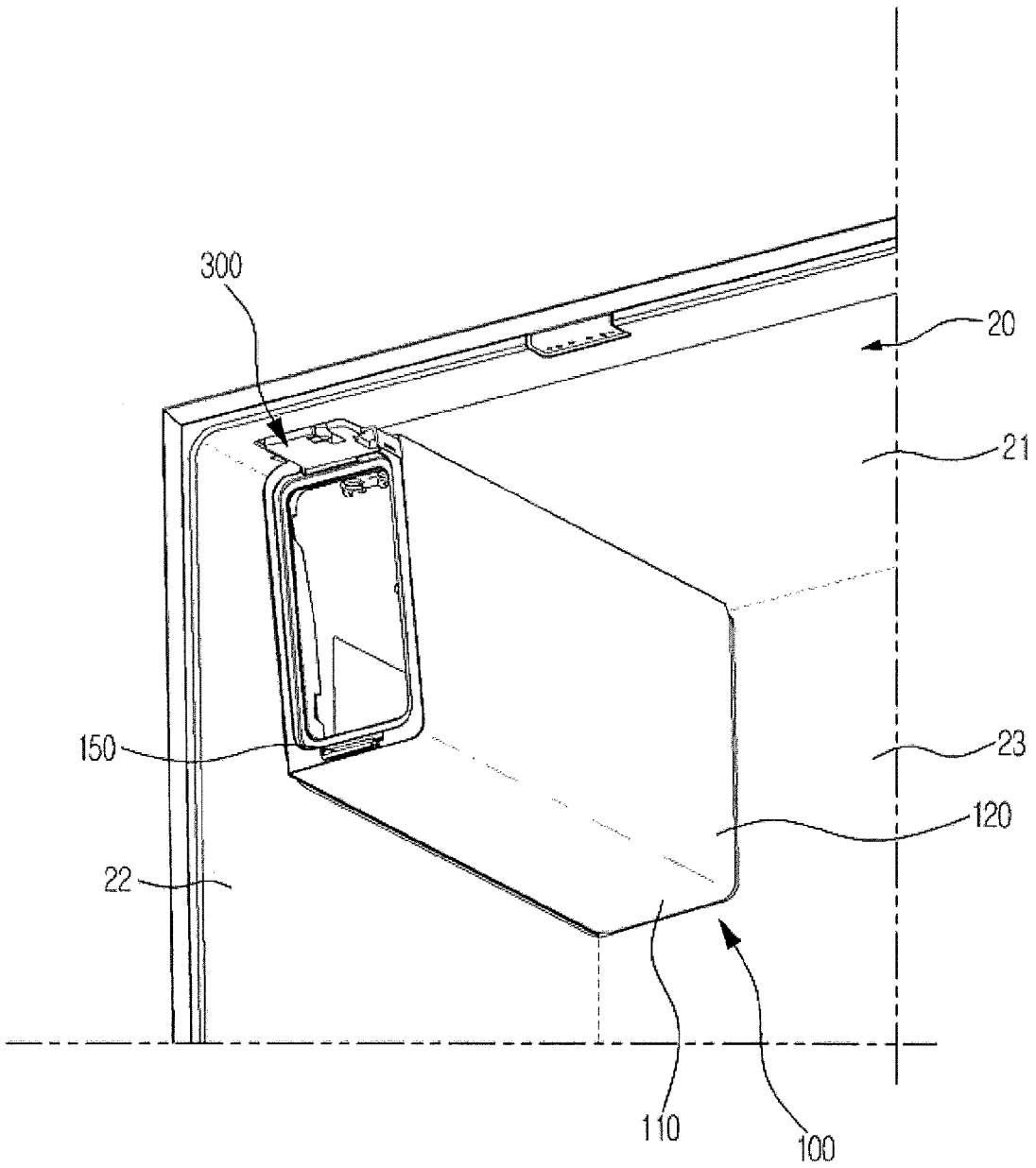
FIG. 4 is a view showing a state in which an ice bucket is drawn out of an ice-making chamber of the refrigerator of FIG. 1.
Figure 5:
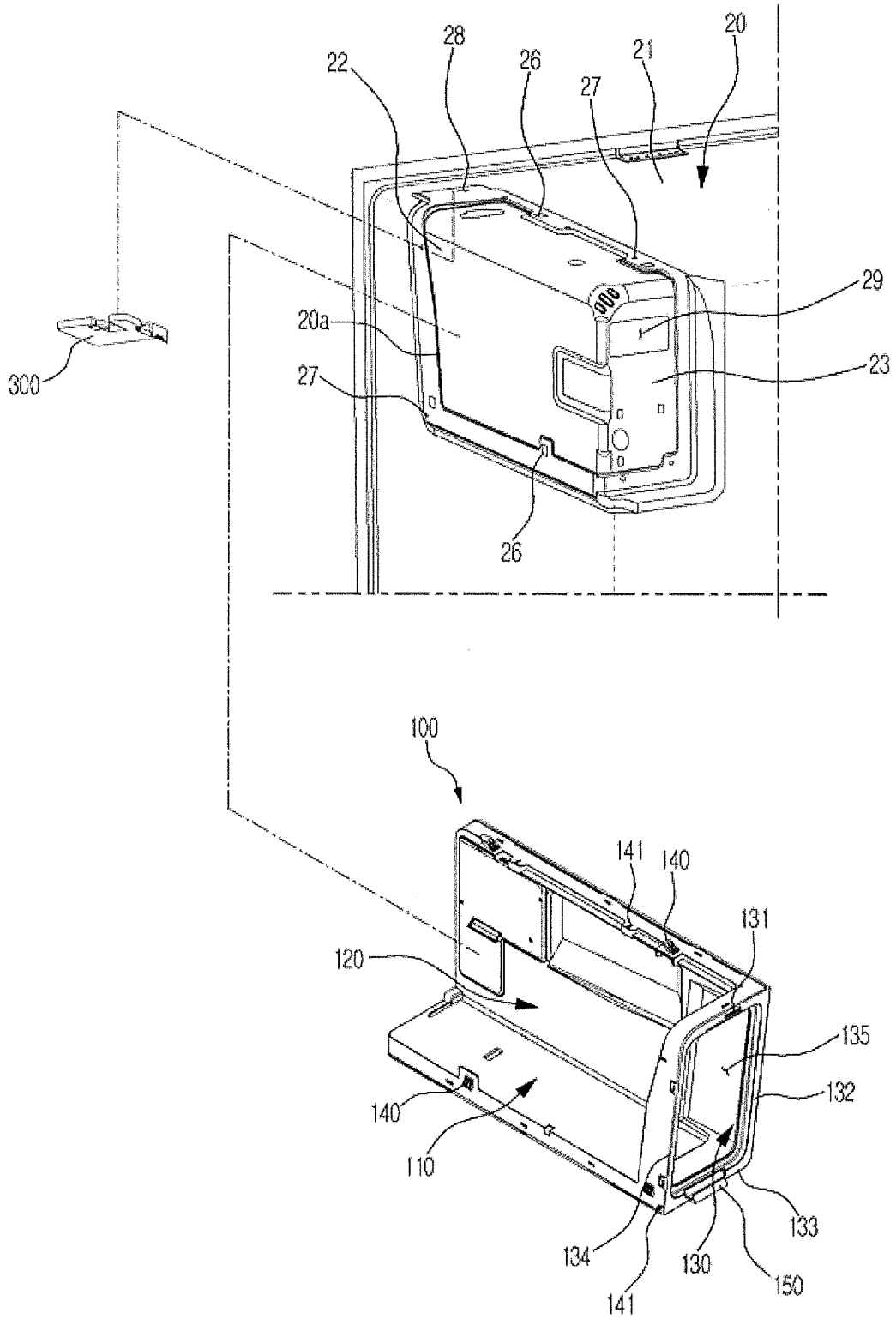
FIG. 5 is an exploded view showing an ice-making chamber case and a locking device in the refrigerator of FIG. 1.

FIG. 1 is a perspective view showing an appearance of a refrigerator in accordance with an embodiment of the present disclosure, FIG. 2 is a schematic side cross-sectional view showing the refrigerator of FIG. 1, FIG. 3 is a view showing a state in which an ice bucket is drawn into an ice-making chamber of the refrigerator of FIG. 1, FIG. 4 is a view showing a state in which an ice bucket is drawn out of an ice-making chamber of the refrigerator of FIG. 1, and FIG. 5 is an exploded view showing an ice-making chamber case and a locking device in the refrigerator of FIG. 1.

Referring to FIGS. 1 to 5, a refrigerator 1 according to an embodiment of the present disclosure includes a main body 10, storage chambers 50 and 60 that are formed inside the main body 10 so as to be partitioned from each other, an ice-making chamber 70, and a cold air supply device that supplies code air to the storage chambers 50 and 60 and the ice-making chamber 70.

The main body 10 includes an inner case 20 that forms the storage chambers 50 and 60 and the ice-making chamber 70 therein, an outer case 30 that is coupled to an outer side of the inner case 20 to form an appearance of the refrigerator 1, and a main body-heat insulating material 40 that is foamed between the inner case 20 and the outer case 30.

The inner case 20 may include an upper wall 21 of FIG. 3, both sidewalls 22 of FIG. 3, a rear wall 23 of FIG. 3, an intermediate wall 25 of FIG. 2, and a bottom wall 24 of FIG. 2. In the rear wall 23, an opening 29 through which a refrigerant tube 225 is inserted into the inner case 20 may be formed. The intermediate wall 25 may partition the storage chambers 50 and 60 into an upper refrigerating chamber 50 and a lower freezing chamber 60. The inner case 20 may be made of integrally injection-molded plastic material.

The outer case 30 may be coupled to an outer side of the inner case 20, and made of a metal material so as to be aesthetically pleasing and durable.

The heat insulating material 40 is provided between the inner case 20 and the outer case 30 to insulate the storage chambers 50 and 60 and the ice-making chamber 70.

The heat insulating material 40 may be formed in such a manner that a liquid foaming solution such as urethane is injected between the inner case 20 and the outer case 30 and expanded.

The refrigerating chamber 50 may be maintained at a temperature of about 0° C. to refrigerate and store food, and the freezing chamber 60 may be maintained at a temperature of less than 0° C. to freeze and store food.

Each of the refrigerating chamber 50 and the freezing chamber 60 has an opened front surface so that food may be drawn into and out of the refrigerating chamber 50 and the freezing chamber 60. The opened front surface of the refrigerating chamber 50 may be opened and closed by a pair of rotary doors 80 and 81 that are hinge-coupled to the main body 10, and the opened front surface of the freezing chamber 60 may be opened and closed by a sliding door 82 that can be slidably drawn into and out of the freezing chamber 60.

In any one 80 of the pair of rotary doors 80 and 81, a dispenser 90 through which water or ice inside the refrigerator can be taken out even without opening the doors 80 and 81 from the outside may be provided. The dispenser 90 may include a guide passage 91 that is connected with an ice discharging port 206 of an ice bucket 200 to guide ice, a take-out space 92 in which a vessel such as a cup is put to take out water or ice, and an operating lever 93 that determines whether to take out water or ice.

Meanwhile, the ice-making chamber 70 of the refrigerator 1 according to an embodiment of the present disclosure may be formed by the inner case 20 and an ice-making chamber case 100 that is coupled to an inner side of the inner case 20.

The ice-making chamber case 100 may have a horizontal wall 110 and a vertical wall 120, and the horizontal and vertical walls 110 and 120 of the ice-making chamber case 100, and the upper wall 21, one side wall 22, and the rear wall 23 of the inner case 20 may form the ice-making chamber 70.

At least one latched hole 26 and at least one first fastening hole 27 may be provided in the inner case 20, and at least one latch protrusion 140 and at least one second fastening hole 141 may be provided in the ice-making chamber case 100. Accordingly, the ice-making chamber case 100 may be temporarily fixed on the inner side of the inner case 20 by inserting the at least one latch protrusion 140 into the at least one latched hole 26, and then a fastening member such as a screw may be fastened to the first fastening hole 27 and the second fastening hole 141, whereby the ice-making chamber case 100 may be firmly fixed on the inner side of the inner case 20.

A concave groove 20*a* may be formed in a portion of the inner case 20 to which the ice-making chamber case 100 is coupled, and the ice-making chamber case 100 may be inserted into the concave groove 20*a*. Accordingly, a sealing force between the ice-making chamber case 100 and the inner case 20 may be improved. Here, in order to further improve the sealing force between the ice-making chamber case 100 and the inner case 20, a sealing member (not shown) such as sponge may be interposed therebetween.

Meanwhile, the ice-making chamber case 100 may further include a front surface edge unit 130 with which the ice bucket 200 is brought into close contact. The front surface edge unit 130 includes a first edge portion 131 that is brought into close contact with the upper wall 21 of the inner case 20, a second edge portion 132 that forms at least a part of the vertical wall 120, a third edge portion 133 that forms at least a part of the horizontal wall 110, and a fourth edge portion 134 that is brought into close contact with the sidewall 22 of the inner case 20. A front surface opening 135 through which an ice storage box 201 of the ice bucket 200 passes may be formed at a center portion of the front surface edge unit 130.

The ice-making chamber 70 may include an ice-making tray 160 that includes at least one ice-making cell in which water is fed to create ice, a drain duct 170 that collects defrost water of the ice-making tray 160, an ejector 161 that moves the ice created in the ice-making tray 160, an ice bucket 200 that stores the ice moved from the ice-making tray 160, an auger 180 that transports the ice stored in the ice bucket 200, an auger motor 181 that drives the auger 180, and an ice-making chamber blower fan 182 that forcibly causes air inside the ice-making chamber 70 to flow.

Meanwhile, a part of the refrigerant tube 225 may be inserted into the ice-making chamber 70 so that cool air may be directly created inside the ice-making chamber 70. The inserted refrigerant tube 225 may be brought into contact with the ice-making tray 160, and the ice-making tray 160 may act as a heat exchanger. The ice-making tray 160 may be made of a material having high thermal conductivity such as aluminum so as to increase heat exchange efficiency.

Here, a refrigerant tube-heat insulating material 190 may be coupled to the refrigerant tube 225 so as to prevent implantation due to a temperature difference with ambient air. As a material of the heat insulating material 190, extruded polystyrene foam, which is light and has a superior insulating effect, may be used. The heat insulating material 190 may be fixed by the main body-heat insulating material 40 that is foamed between the inner case 20 and the outer case 30.

The ice bucket 200 may include an ice storage box 201 having an ice storage space 202 and a cover unit 203 that is formed on a front surface of the ice storage box 201. The cover unit 203 is brought into close contact with the front surface edge unit 130 to close the opened front surface of the ice-making chamber 70. In the cover unit 203, a gasket 219 of FIGS. 11 and 12 for increasing a sealing force with the front surface edge unit 130 of the ice-making chamber case 100 may be provided.

In addition, in the cover unit 203, an ice crushing space 204 may be formed, and a crushing blade 205 for crushing ice may be disposed. The crushing blade 205 may crush the ice created in the ice-making tray 160 into pieces while being rotated. A user may select whether to crush ice, and the crushed ice pieces or the non-crushed ice may be discharged to the outside of the ice bucket 200 through the ice discharging port 206 in accordance with the selection of the user.

The ice bucket 200 may be provided so as to be drawn out from the inside of the ice-making chamber 70 to the outside thereof, so that the ice may be easily taken out when a large amount of ice stored in the ice storage space 202 is used. That is, the ice bucket 200 may be slidably drawn into the ice-making chamber 70 from the outside of the ice-making chamber 70, or slidably drawn out to the outside of the ice-making chamber 70 from the inside thereof.

In addition, in the refrigerator 1, a locking device 300 that can lock the ice bucket 200 while the ice bucket is drawn into the ice-making chamber 70 may be provided. The locking device 300 may be coupled to a locking device installation unit 28 of FIG. 5 formed in the upper wall 21 of the front inner case 20 of the ice-making chamber 70. A configuration of the locking device 300 will be described later.

Meanwhile, the cold air supply device that supplies cold air to the refrigerating chamber 50, the freezing chamber 60, and the ice-making chamber 70 may include a compressor 220 that compresses refrigerant, a condenser 221 that condenses the compressed refrigerant, expanding devices 223 and 224 that expand refrigerant, evaporators 234 and 244 that evaporate refrigerant, the refrigerant tube 225 that guides refrigerant, and a flow passage switching valve 222 that switches a flow passage of refrigerant. The compressor 220 and the condenser 221 may be disposed in a machine room 71 formed in a rear lower portion of the main body 10.

The cold air supply device may circulate refrigerant in a cycle of compression, condensation, expansion, and evaporation to thereby create cool air, and include a first cycle for cooling the freezing chamber 60 and a second cycle for cooling the refrigerating chamber 50 and the ice-making chamber 70. The first cycle and the second cycle may be selectively or simultaneously operated.

Refrigerant in the first cycle may supply cool air to the freezing chamber 60 while being sequentially circulated in the compressor 220, the condenser 221, the flow passage switching valve 222, the first expanding device 223, the freezing chamber evaporator 244, and the compressor 220.

In the freezing chamber 60, a freezing chamber duct 240 in which the freezing chamber evaporator 244 is installed, a freezing chamber blower fan 241, a freezing chamber discharging port 242, and a freezing chamber inlet port 243 may be provided.

Cool air created in the freezing chamber evaporator 244 may be discharged to the freezing chamber 60 through the freezing chamber discharging port 242 to cool the inside of the freezing chamber 60, and then inhaled again to the freezing chamber duct 240 through the freezing chamber inlet port 243.

The cool air may be supplied to the refrigerating chamber 50 and the ice-making chamber 70 while refrigerant in the second cycle is sequentially circulated in the compressor 220, the condenser 221, the flow passage switching valve 222, the second expanding device 224, the freezing chamber evaporator 234, and the compressor 220.

In the refrigerating chamber 50, a refrigerating chamber duct 230 in which the refrigerating chamber evaporator 234 is installed, a refrigerating chamber blower fan 231, a refrigerating chamber discharging port 232, and a refrigerating chamber inlet port 233 may be provided. Cool air created in the refrigerating chamber evaporator 234 may be discharged to the refrigerating chamber 50 through the refrigerating chamber discharging port 232 to cool the inside of the refrigerating chamber 50, and then inhaled again to the refrigerating chamber duct 230 through the refrigerating chamber inlet port 233.

Air blown by the ice-making chamber blower fan 182 may exchange heat with the ice-making tray 160 and the refrigerant tube 225 while passing between the ice-making tray 160 and the drain duct 170, and the cooled air may pass through the ice crushing space 204 and the ice storage space 202 of the ice bucket 200 to flow again to the blower fan 182 side.

Figure 6:
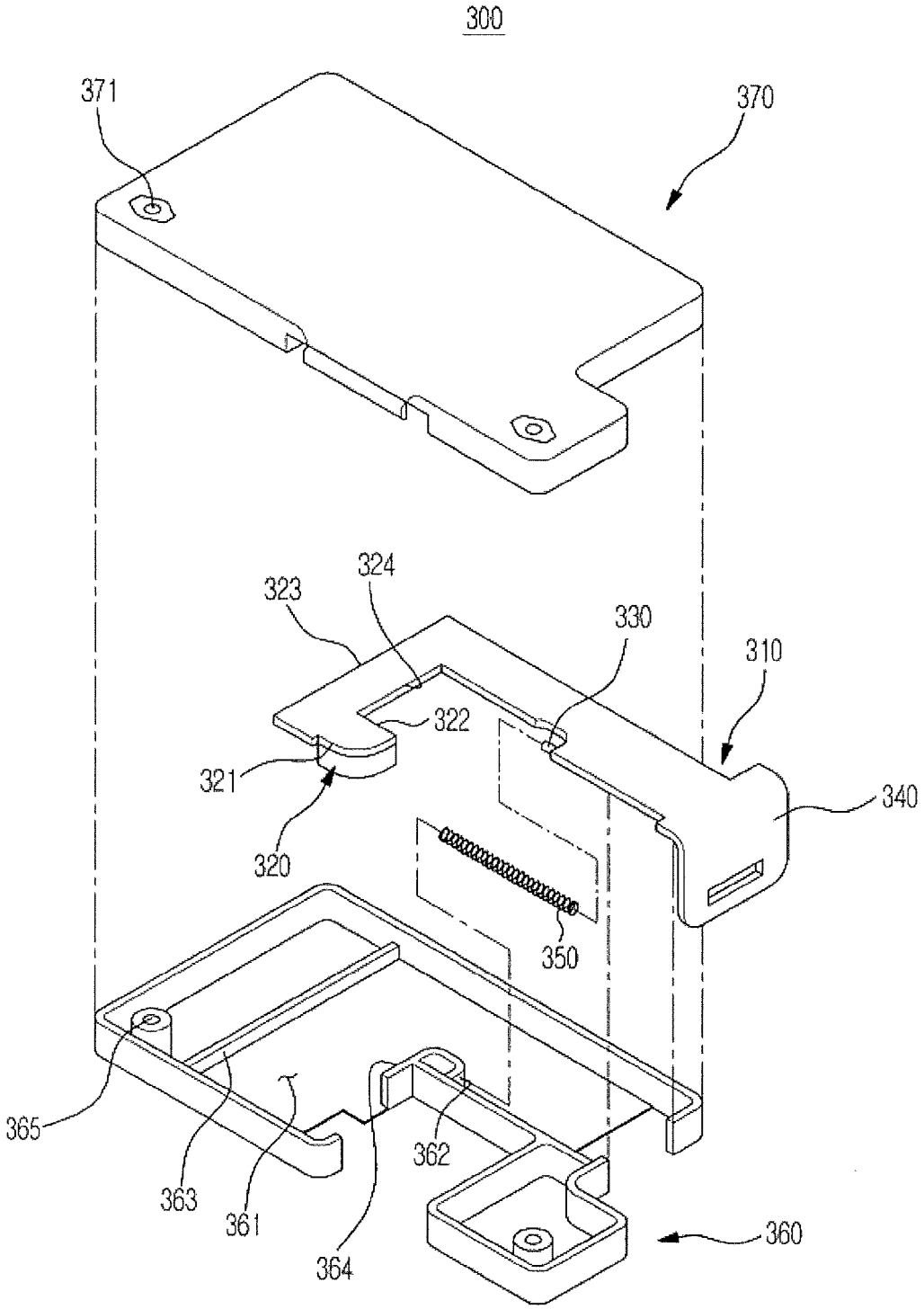
FIG. 6 is an exploded perspective view showing a locking device of the refrigerator of FIG. 1.
Figure 7:
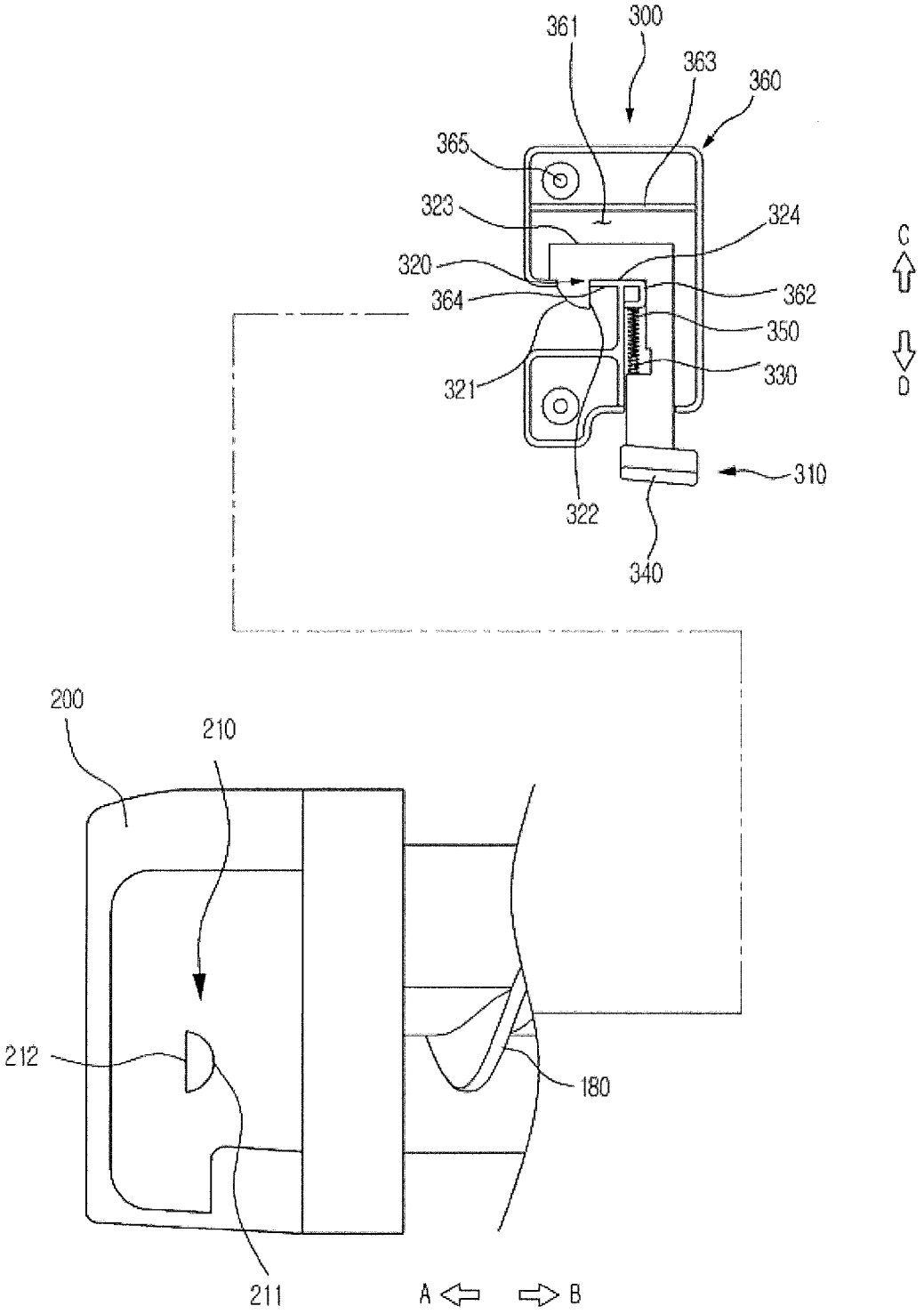
FIG. 7 is a plan view showing an ice bucket and a locking device of the refrigerator of FIG. 1.
Figure 8:
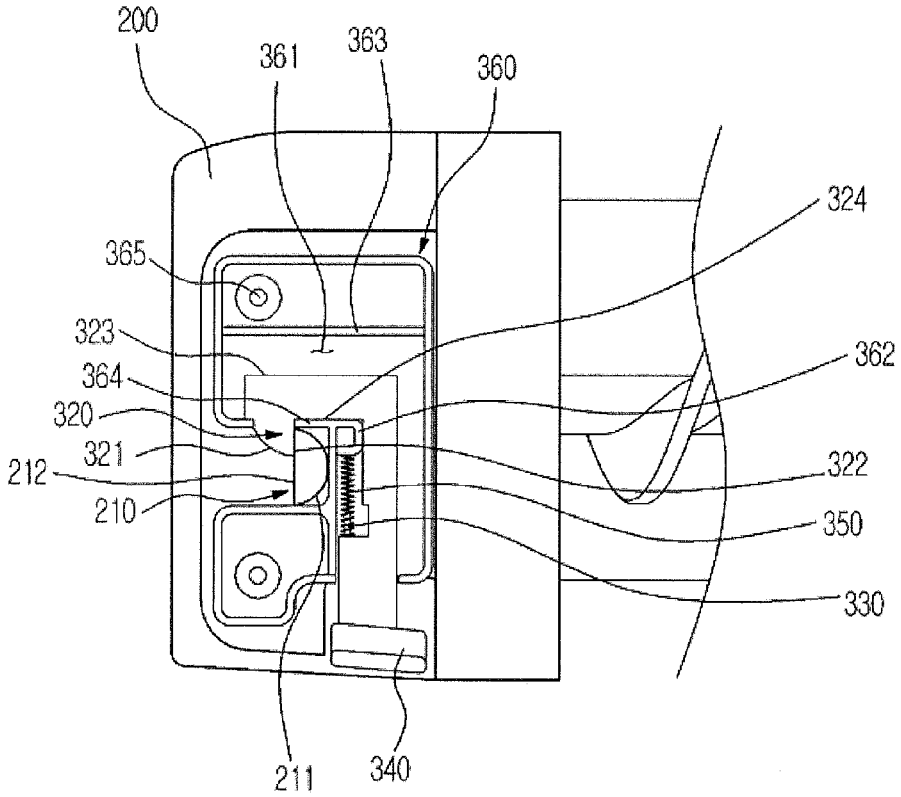
FIG. 8 is a view showing a state in which an ice bucket of the refrigerator of FIG. 1 is locked by a locking device.
Figure 9:
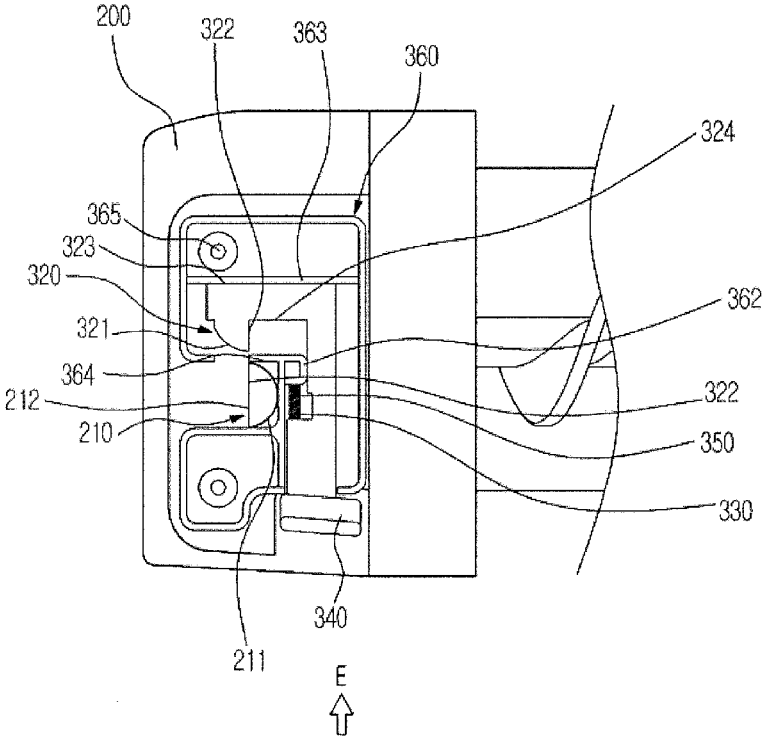
FIG. 9 is a view showing a state in which a push unit of a movement member is pressurized so as to unlock an ice bucket of the refrigerator of FIG. 1.
Figure 10:
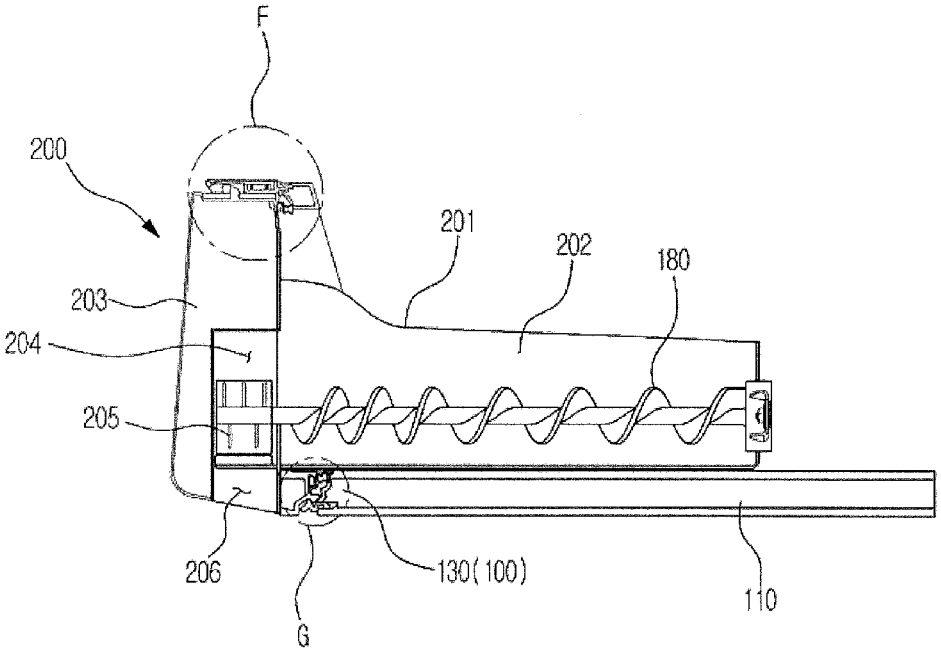
FIG. 10 is a cross-sectional view showing an ice bucket, a locking device, and an ice-making chamber case of the refrigerator of FIG. 1.
Figure 11:
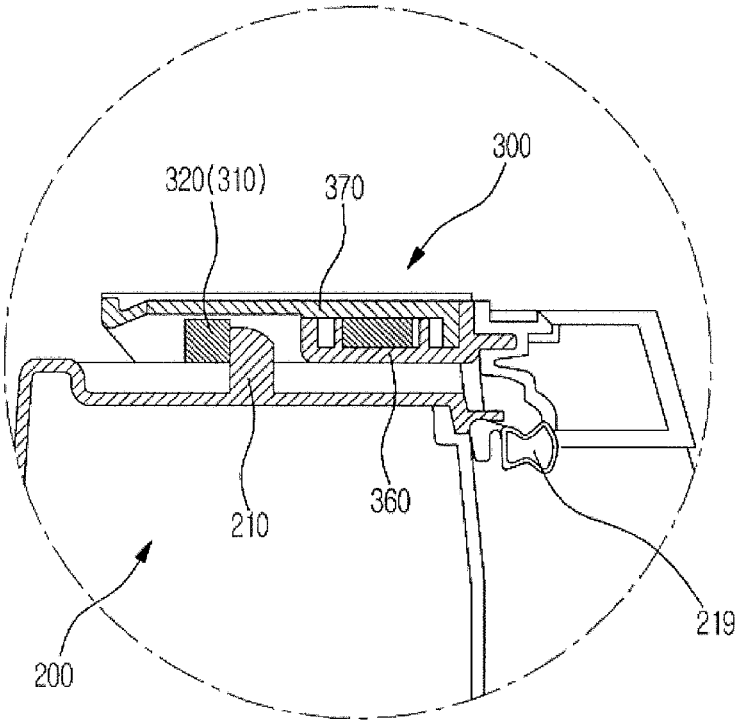
FIG. 11 is an enlarged view showing an F region of FIG. 10.

FIG. 6 is an exploded perspective view showing a locking device of the refrigerator of FIG. 1, FIG. 7 is a plan view showing an ice bucket and a locking device of the refrigerator of FIG. 1, FIG. 8 is a view showing a state in which an ice bucket of the refrigerator of FIG. 1 is locked by a locking device, FIG. 9 is a view showing a state in which a push unit of a movement member is pressurized so as to unlock an ice bucket of the refrigerator of FIG. 1, FIG. 10 is a cross-sectional view showing an ice bucket, a locking device, and an ice-making chamber case of the refrigerator of FIG. 1, and FIG. 11 is an enlarged view showing an F region of FIG. 10.

Referring to FIGS. 6 to 9, the locking device 300 includes a movement member 310 that is movable in directions C and D perpendicular to movement directions A and B of the ice bucket 200, an elastic member 350 that elastically biases the movement member 310 in the direction D in which the ice bucket 200 is locked, a housing case 360 that includes a housing space 361 for housing the movement member 310 and the elastic member 350, and a cover 370 that is coupled to the housing case 360 so as to cover one opened surface of the housing case 360.

In the housing case 360, an elastic member support unit 362 that supports the elastic member 350 and stoppers 363 and 364 that limit a movement range of the movement member 310 may be formed.

A first contact surface 323 of the movement member 310 may be brought into contact with the first stopper 363, and the movement range of the movement member 310 in the direction C may be limited by the first stopper 363. A second contact surface 324 of the movement member 310 may be brought into contact with the second stopper 364, and the movement range of the movement member 310 in the direction D may be limited by the second stopper 364.

Accordingly, as shown in FIG. 7, when pressurization does not act on the movement member 310, the movement member 310 may be moved in the direction D by the elastic member 350, and the second contact surface 324 may be supported by the second stopper 364.

Meanwhile, the movement member 310 includes a latch unit 320 for locking the ice bucket 200, a push unit exposed to the outside of the housing case 360 so as to pressurize the movement member 310 from the outside, and an elastic member installation bar 330 for installing the elastic member 350.

Here, a latch protrusion 210 that protrudes upwardly may be formed in the ice bucket 200 so as to be interfered with by the latch unit 320 of the movement member 310. Accordingly, the latch protrusion 210 of the ice bucket 200 is interfered with by the latch unit 320 of the movement member 310, whereby the ice bucket 200 may be locked.

More specifically, the latch protrusion 210 of the ice bucket 200 includes a pressurizing surface 211 and a first interference surface 212, and the latch unit 320 includes a pressurized surface 321 pressurized by the pressurizing surface 211 and a second interference surface 322 interfered with by the first interference surface 212.

When the ice bucket 200 is drawn into the ice-making chamber 70, the pressurizing surface 211 of the latch protrusion 210 pressurizes the pressurized surface 321 of the latch unit 320, and therefore the movement member 310 may be moved in the direction C. In this instance, the pressurized surface 321 is preferably formed so as to be inclined so that the movement member 310 may be moved in a direction perpendicular to a pressurizing direction of the pressurizing surface 211.

Here, when the movement member 310 is continuously moved in the direction C, the interferences of the pressurizing surface 211 of the latch protrusion 210 and the pressurized surface 321 of the latch unit 320 may be released, and the latch protrusion 210 may be drawn into the latch unit 320. In this instance, the movement member 310 may be moved again in the direction D by a restoring force of the elastic member 350.

Accordingly, as shown in FIG. 8, the ice bucket 200 may be locked in such a manner that the first interference surface 212 of the latch protrusion 210 is interfered with by the second interference surface 322 of the latch unit 320.

Meanwhile, the locked ice bucket 200 may be unlocked by pressurizing the push unit 340 of the movement member 310 in a direction E as shown in FIG. 9. Here, as shown in FIG. 9, the push unit 340 of the movement member 310 may be provided so as to be exposed to a side of the ice bucket 200.

Fastening holes 365 and 371 for coupling may be provided in each of the housing case 360 and the cover 370, and the locking device 300 may be coupled to the upper wall 21 of the inner case 20 by fastening a fastening member such as a screw to the fastening holes 365 and 371.

Figure 12:
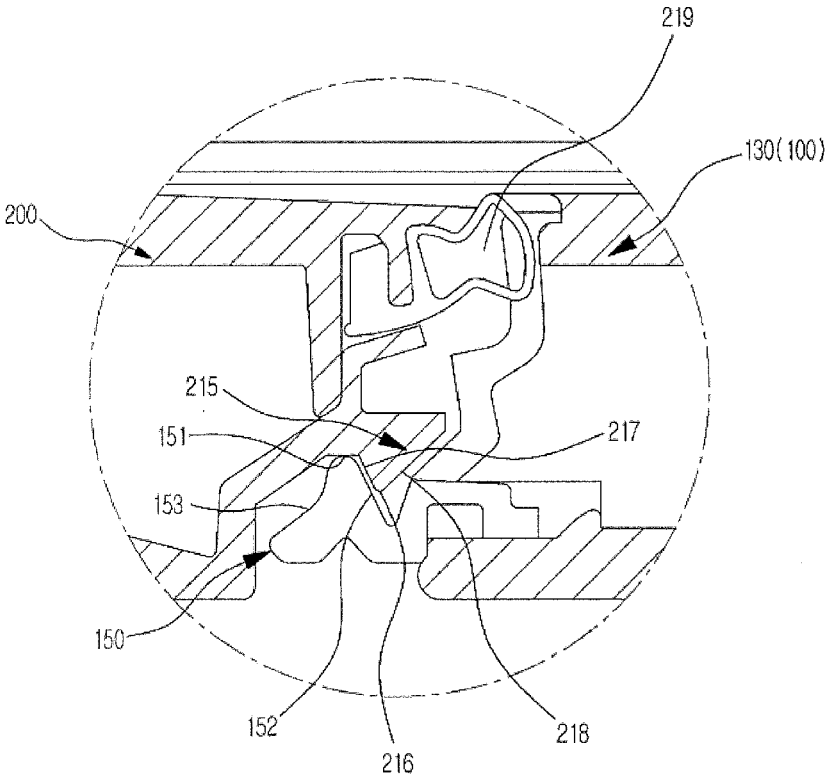
FIG. 12 is an enlarged view showing a G region of FIG. 10.

FIG. 12 is an enlarged view showing a G region of FIG. 10.

Referring to FIGS. 10 and 12, a lower fixing structure of the ice bucket 200 of the refrigerator according to an embodiment of the present disclosure will be described. However, the repeated descriptions of the above-described configuration will be omitted.

The refrigerator according to an embodiment of the present disclosure may have a lower fixing structure other than the above-described locking device 300. The lower fixing structure may provide a supplementary fixing force to a lower portion of the ice bucket 200 fixed by the above-described locking device 300.

The lower fixing structure includes a first lower protrusion 150 that is formed in a lower portion of the front surface edge unit 130 of the ice-making chamber case 100 and a second lower protrusion 215 that is formed in the lower portion of the ice bucket 200. The first lower protrusion 150 and the second lower protrusion 215 may be coupled to each other to thereby fix the lower portion of the ice bucket 200.

More specifically, the first lower protrusion 150 includes a first latch corner 151 on an upper side thereof, a first interference surface 152 that is formed so as to be inclined downward to an inner side of the first lower protrusion 150 from the first latch corner 151, and a first guide surface 153 that is formed so as to be inclined downward to an outer side of the first lower protrusion 150 from the first latch corner 151.

The second lower protrusion 215 includes a second latch corner 216 on a lower side thereof, a second interference surface 217 that is formed so as to be inclined upward to an inner side of the second lower protrusion 215 from the second latch corner 216, and a second guide surface 218 that is formed upward to an outer side of the second lower protrusion 215 from the second latch corner 216.

When the ice bucket 200 proceeds to the inside of the ice-making chamber, the second lower protrusion 215 may be interfered with by the first lower protrusion 150, whereby the lower portion of the ice bucket 200 may be fixed.

More specifically, the second interference surface 217 of the second lower protrusion 215 is interfered with by the first interference surface 152 of the first lower protrusion 150, and therefore the second lower protrusion 215 and the first lower protrusion may be interfered with.

The first interference surface 152 and the second interference surface 217 may be formed so as to be inclined at approximately the same angle, and therefore the interference may be easily released by slightly lifting up the ice bucket 200 when drawing out the ice bucket 200.

The first guide surface 153 and the second guide surface 218 may be used for guiding the ice bucket 200 so that the first lower protrusion 150 and the second lower protrusion 215 may be easily coupled to each other. The first guide surface 153 and the second guide surface 218 may be formed so as to be inclined at approximately the same angle, so that the ice bucket 200 may be slidably moved while the first guide surface 153 and the second guide surface 218 are brought into contact with each other when the ice bucket 200 proceeds to the inside of the ice-making chamber, whereby the first lower protrusion 150 and the second lower protrusion 215 may be easily coupled to each other.

As described above, according to the embodiments of the present disclosure, the locking device that can lock the ice bucket in the ice-making chamber may be provided in the upper wall of the inner case, and only the latch protrusion that is coupled to the locking device may be provided in the ice bucket, and therefore a structure of the ice bucket may be simplified.

In addition, according to the conventional structure in which the locking device is installed in the ice bucket, a lever unit that can operate the locking device should be disposed so as to penetrate the inside and the outside of the ice bucket, and therefore cool air of the inside of the ice bucket may leak through a through portion which the lever unit penetrates. However, in the case of the ice bucket according to the embodiment of the present disclosure, there is no through portion, and thus leakage of the cool air of the inside of the ice bucket may be prevented.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a main body that includes an inner case having an upper wall, both sidewalls, a rear wall, and a bottom wall, an outer case coupled to an outer side of the inner case, and a heat insulating material foamed between the inner case and the outer case;

a storage chamber that is formed inside the inner case;

an ice-making chamber that is formed so as to be partitioned from the storage chamber, at least a part of the ice-making chamber being formed by the upper wall and the both sidewalls;

an ice-making tray that is disposed inside the ice-making chamber to create ice;

an ice bucket that stores the ice created in the ice-making tray, and is drawn into the ice-making chamber or drawn to the outside of the ice-making chamber, the ice bucket including an ice storage box and a cover unit formed on a front surface of the ice storage box, the cover unit including a latch protrusion protruding upwardly from an upper surface of the cover unit; and a locking device that locks or unlocks the ice bucket drawn into the ice-making chamber, the locking device being formed separately from the ice bucket and coupled to the upper wall of the inner case above the cover unit, the locking device including a movement member having a latched portion configured to be interfered with by the latch protrusion and an elastic member configured to elastically bias the movement member in a direction in which the latched portion is interfered with by the latch protrusion, wherein the movement member includes a push unit configured to be pushed in a horizontal direction to release the interference of the latched portion and the latch protrusion by pressurizing the movement member.

2. The refrigerator according to claim 1, wherein the locking device further comprises:

a housing case having a housing space for housing the movement member and the elastic member and one opened surface; and a cover coupled to the one opened surface of the housing case so as to cover the one opened surface of the housing case.

3. The refrigerator according to claim 1, wherein the latch protrusion includes a pressurizing surface for pressurizing the latched portion and a first interference surface interfered with by the latched portion, and the latched portion includes a pressurized surface pressurized by the pressurizing surface and a second interference surface interfered with by the first interference surface to lock the ice bucket.

4. The refrigerator according to claim 3, wherein the pressurized surface is formed so as to be inclined so that the movement member is moved in a direction perpendicular to an advancing direction of the ice bucket when the pressurized surface is pressurized by the pressurizing surface.

5. The refrigerator according to claim 1, further comprising:

an ice-making chamber case that is coupled to an inner side of the inner case so as to form the ice-making chamber and has a front surface edge unit with which the ice bucket is brought into close contact, wherein a first lower protrusion that protrudes so as to fix a lower portion of the ice bucket is formed in a lower portion of the front surface edge unit, and a second lower protrusion that is interfered with by the first lower protrusion is formed in the lower portion of the ice bucket.

6. The refrigerator according to claim 5, wherein the ice bucket that is drawn into the ice-making chamber and fixed by the first lower protrusion and the second lower protrusion is lifted up to release the interference between the first lower protrusion and the second lower protrusion, and drawn to the outside of the ice-making chamber.

7. The refrigerator according to claim 5, wherein the first lower protrusion includes a first latch corner and a first interference surface formed so as to be inclined on an inner side of the first latch corner, the second lower protrusion includes a second latch corner and a second interference surface formed so as to be inclined on an inner side of the second latch corner, and the lower portion of the ice bucket is fixed to a lower portion of the ice-making chamber case in such a manner that the first interference surface is interfered with by the second interference surface.

8. The refrigerator according to claim 7, wherein the first lower protrusion includes a first guide surface that is formed so as to be inclined on an outer side of the first latch corner, and the second lower protrusion includes a second guide surface that is formed so as to be inclined on an outer side of the second latch corner so that the second guide surface is slidably moved on the first guide surface to guide the ice bucket.

* * * * *